US006551473B1

(12) United States Patent
Gaillard et al.

(10) Patent No.: US 6,551,473 B1
(45) Date of Patent: Apr. 22, 2003

(54) ELECTROLYTIC CELL ARRANGEMENT FOR PRODUCTION OF ALUMINUM

(75) Inventors: Jean-Marie Gaillard, Saint Pierre d'Albigny (FR); Jacques Colin de Verdiere, Marcilly d'Azergues (FR); Pierre Homsi, Saint Egreve (FR)

(73) Assignee: Aluminium Pechiney, Paris (FR)

( * ) Notice: Subject to any disclaimer, the term of this patent is extended or adjusted under 35 U.S.C. 154(b) by 0 days.

(21) Appl. No.: 09/890,764

(22) PCT Filed: Feb. 1, 2000

(86) PCT No.: PCT/FR00/00228

§ 371 (c)(1),
(2), (4) Date: Oct. 24, 2001

(87) PCT Pub. No.: WO00/46429

PCT Pub. Date: Aug. 10, 2000

(30) Foreign Application Priority Data

Feb. 5, 1999 (FR) ..... 99 01529

(51) Int. Cl.[7] ..... C25C 3/16
(52) U.S. Cl. ..... 204/244; 204/247.1
(58) Field of Search ..... 204/244, 247.1

(56) References Cited

U.S. PATENT DOCUMENTS

| | | | | |
|---|---|---|---|---|
| 4,474,610 A | * | 10/1984 | Kato et al. | 204/244 X |
| 4,474,611 A | | 10/1984 | Blanc et al. | |
| 4,592,821 A | | 6/1986 | Keinborg et al. | |
| 4,683,047 A | | 7/1987 | Boivin et al. | |
| 4,696,730 A | * | 9/1987 | Chaffy et al. | 204/244 X |
| 4,713,161 A | * | 12/1987 | Chaffy et al. | 204/244 X |
| 5,882,499 A | | 3/1999 | Bonnardel et al. | |

OTHER PUBLICATIONS

Asset, R., "Mecanisation en continu de la reduction de l'alumine par les anodes de carbone", La Technique Moderne, 1972, 65–67, vol. 64, No. 12. (No month).

* cited by examiner

*Primary Examiner*—Donald R. Valentine
(74) *Attorney, Agent, or Firm*—Connolly Bove Lodge & Hutz LLP

(57) ABSTRACT

An arrangement of electrolysis pots suitable for use for the production of aluminum by igneous electrolysis according to the Hall-Héroult process with an electrolysis current with intensity Io is disclosed. The arrangement comprises juxtaposed zones including an inner lateral zone. a central zone, and an outer lateral zone. The arrangement can be used, for example, in an electrolysis plant.

22 Claims, 3 Drawing Sheets

ELECTROLYTIC CELL ARRANGEMENT FOR PRODUCTION OF ALUMINUM

DOMAIN OF THE INVENTION

Figure 1:
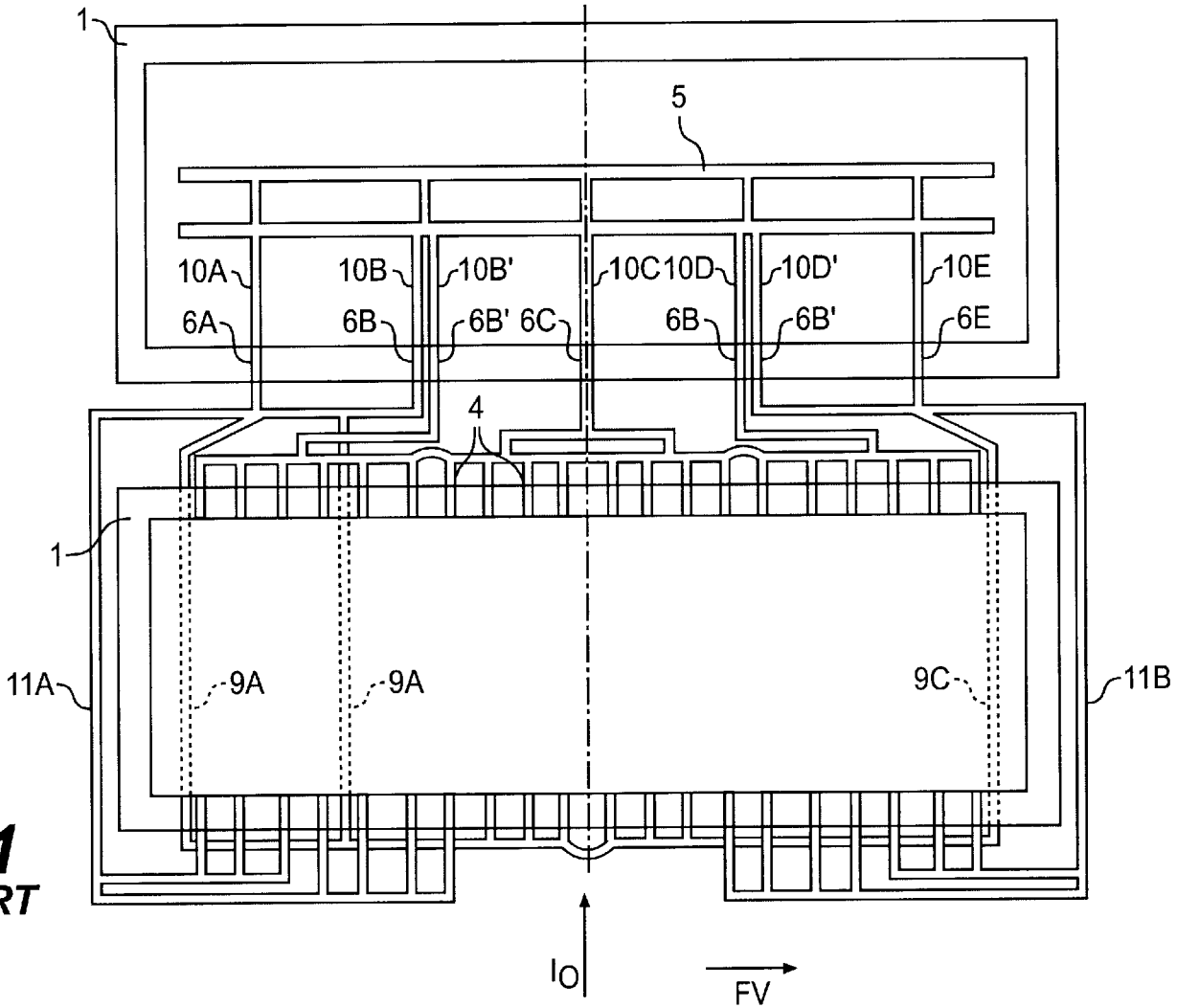
FIG. 1 PRIOR ART

The invention relates to the production of aluminum by igneous electrolysis according to the Hall-Héroult process, and more particularly to methods and means of implementing it industrially. In particular, the invention relates to lines of electrolysis pots laid out crosswise, in other words with their long sides perpendicular to the centerline of the line.

1. State of the Art

Metal aluminum is produced industrially by igneous electrolysis, namely by the electrolysis of aluminum in solution in a molten cryolith bath called an electrolysis bath according to the well known Hall-Héroult process. The electrolysis bath is contained in a pot including a steel shell lined on the inside with refractory and/or insulating materials, and a cathodic assembly located at the bottom of the pot. Anodes made of carbonaceous material are partially immersed in the electrolysis bath. The pot and the anodes form what is frequently called an electrolysis cell. The electrolysis current that passes through the electrolysis bath and the liquid aluminum layer through the anodes and cathodic elements, brings about alumina reduction reactions and also keeps the electrolysis bath at a temperature of the order of 950° C. by the Joule effect.

In order to maintain the profitability of a plant, efforts are made firstly to reduce investments and operating costs, and secondly to obtain the highest possible current intensities and current efficiencies at the same time, while protecting and even improving operating conditions of the electrolysis cells.

Consequently, the most modern plants contain a large number of electrolysis cells laid out in line in "electrolysis" pot rooms electrically connected in series using connecting conductors in order to optimize the occupancy of factory floors. The pots, that are almost always rectangular in shape, are usually laid out side by side, in other words with the long sides perpendicular to the center line of the line (it is also said that they are laid out "crosswise") but they may also be placed head to head (in this case they are said to be laid out "lengthwise"). The pots are usually arranged to form two or several parallel lines that are electrically connected to each other by end conductors. The electrolysis current thus passes in cascade from one cell to the next. The length and weight of the conductors are as small as possible in order to limit the corresponding investment and operating costs, particularly through a reduction of Joule effect losses in conductors. Furthermore, bringing electrolysis pots closer together and increasing the intensities of electrolysis current has led to the development of conductor configurations capable of compensating for the effects of magnetic fields generated by the electrolysis current.

With the same objective, it is known that pots, or lines of pots, can be provided with sophisticated regulation means that enable good control of the electrolysis process. In particular, French application FR 2 753 727 filed by the applicant proposes a detailed temperature regulation process that can give high values of the current efficiency.

Electrolysis pots are usually controlled such that they are in thermal equilibrium, in other words the heat dissipated by each electrolysis pot is globally compensated by the heat produced in the pot, which originates essentially from the electrolysis current. Thermal equilibrium conditions depend on the physical parameters of the pot such as the dimensions and the nature of the materials from which the pot is made, and the pot operating conditions, such as the electrical resistance of the pot, the bath temperature or the intensity of the electrolysis current. The pot is frequently made and operated so that a ridge of solid bath is formed on the sidewalls of this pot, which in particular inhibits attack of the linings of the said walls by the liquid cryolith. The thermal equilibrium point is usually chosen such that the best operating conditions are achieved both technically and economically.

French patent FR 2 552 782 (corresponding to American patent U.S. Pat. No. 4,592,821) in the name of the applicant describes a line of electrolysis pots that can operate industrially at current intensities exceeding 300 kA and with current efficiencies exceeding 90%.

2. Statement of the Problem

The continuous improvement in the performances of electrolysis plants, both technically and economically, has led the applicant to search for global solutions for increasing the cost effectiveness of plants, particularly by allowing for the possibility of a range of pot operating intensities. The possibility of making deliberate variations to operating conditions, which may be quite different from nominal conditions, is often useful in the management of an electrolysis plant. For example, an attempt can be made to vary the power of the series of electrolysis pots as a function of an electrical energy contract.

The applicant has found that electrolysis pots have temperature heterogeneities and more precisely a dispersion of temperature values within the liquid mass which, although relatively small, tend to be constant over time, in other words some differences between local temperatures and the average temperature of the pot are not cancelled by averaging over in time. In particular, these heterogeneities have the disadvantage that they limit the accuracy of the temperature regulation of the pots. Known regulation processes can control temperature fluctuations in time, but do not necessarily limit the dispersion of temperatures over the entire pot. Furthermore, zones in which the temperature is below the said temperature encourage material deposits at the bottom of the pot and the formation of extending ridges (in other words part of the ridge partially covers the cathode) that increase the cathodic voltage drop and are the cause of pot instabilities, and zones in which the temperature is higher than the set temperature, tend to reduce the protective solidified bath ridges on the sides of the pot and possibly lead to non-uniform wear of the linings.

Therefore, the applicant searched for means of reducing the temperature dispersion and temperature fluctuations in electrolysis pots that would overcome the disadvantages of prior art while remaining satisfactory for the general pot design, particularly concerning floor occupancy and investment in operating costs, and for operation of the pots.

3. Purpose of the Invention

The first object of the invention is an arrangement of electrolysis pots laid out crosswise for the production of aluminum by igneous electrolysis according to the Hall-Héroult process.

Another object of the invention is an electrolysis plant including an arrangement of pots according to the first object of the invention.

DESCRIPTION OF THE INVENTION

According to the invention, the arrangement of electrolysis pots for the production of aluminum by igneous electrolysis according to the Hall-Héroult process with an electrolysis current with intensity To includes at least one first line of electrolysis pots forming a first electrical circuit and at least one second electrical circuit located at a determined average distance from the said first line, the said first line including N pots arranged crosswise and connecting conductors to transmit the said electrolysis current Io from a pot in the first line called the upstream pot, to the next pot in the said line called the downstream pot, each pot including a metal shell, internal lining elements, anodes and cathodic elements, the said cathodic elements being provided with cathodic connection ends projecting on the upstream side and the downstream side of the shell of each pot, a first part Im of the current Io being output through the cathodic ends projecting from the upstream side of each pot, a second part Iv of the current Io being output through the cathodic ends projecting from the downstream side of each pot, the said connecting conductors including rising conductors called "risers", the current Io output from all cathodic elements in an upstream pot being transmitted to the anodes of the downstream pot through the said risers, and characterized in that at least one "axial" conductor passes under each upstream pot in the central zone, in that at least one "lateral" conductor passes under each upstream pot in the inner lateral zone, in other words the zone of each pot located on the side of the said second electrical circuit, in that at least one "bypass" conductor goes around each upstream pot, in that the or each lateral conductor is connected to a first set of the said cathodic ends located on the upstream side in order to transmit a first part I1 of the current Im, between 10 and 20% of the said current Im, to the said risers, and in that the or each axial conductor is connected to a second set of the said cathodic ends located on the upstream side in order to transmit a second part I2 of the said current Im, between 10 and 20% of the said current Im, to the said risers, in that the or each bypass conductor is connected to a third set of the said cathodic ends located on the upstream side in order to transmit a third part I3 of the current Im corresponding to the rest of the current Im, in that the said risers are connected to the cathodic ends located on the downstream side of the corresponding upstream pot, to the conductors passing under the said pot and to the or each bypass conductor of the said pot, such that a fraction Mc of the current Io less than 15%, and preferably less than 10%, is transmitted through the risers located in the central part of the line.

The lateral and central zones of the pot and of the line are delimited by two imaginary vertical planes parallel to the centerline of the line. Each of the said planes intersects the pots so as to form three zones corresponding to three comparable volumes of liquid mass inside each pot in the line. Preferably, the central volume is between 25 and 40% of the total volume, and preferably between 30 and 35% of the total volume. The exact volume of each zone, and the exact distribution of the current under the pot, depend on the pot structure (particularly the number of cathodic ends) and the pot operating mode (particularly the thickness of the solidified bath ridges on the edges of the pot crucible, which will modify the distribution of the liquid masses).

The said second electrical circuit also called the "neighboring line" in the rest of the text is usually approximately parallel to the line and usually includes at least one electrolysis pot. It usually includes a line of electrolysis pots, but it may possibly be composed of conductors only. During operation, a current with intensity Io' circulates in the said second circuit. The arrangement of the pots is preferably such that the intensities of the currents Io and Io' are approximately equal and that they are in directions opposite to each other.

The upstream current to the electrolysis pots is shared between the conductors depending on the intensity of the current in line Io and the intensity of the current in the neighboring line Io', and the distance between the two lines of pots.

DESCRIPTION OF THE FIGS.

FIG. 1 shows the electrical connection between two successive pots in a line according to prior art (corresponding to French patent FR 2 552 782 and American patent U.S. Pat. No. 4,592,821). The direction of the neighboring line is shown by arrow FV. The direction of the electrolysis current is shown by arrow Io.

Figure 2:
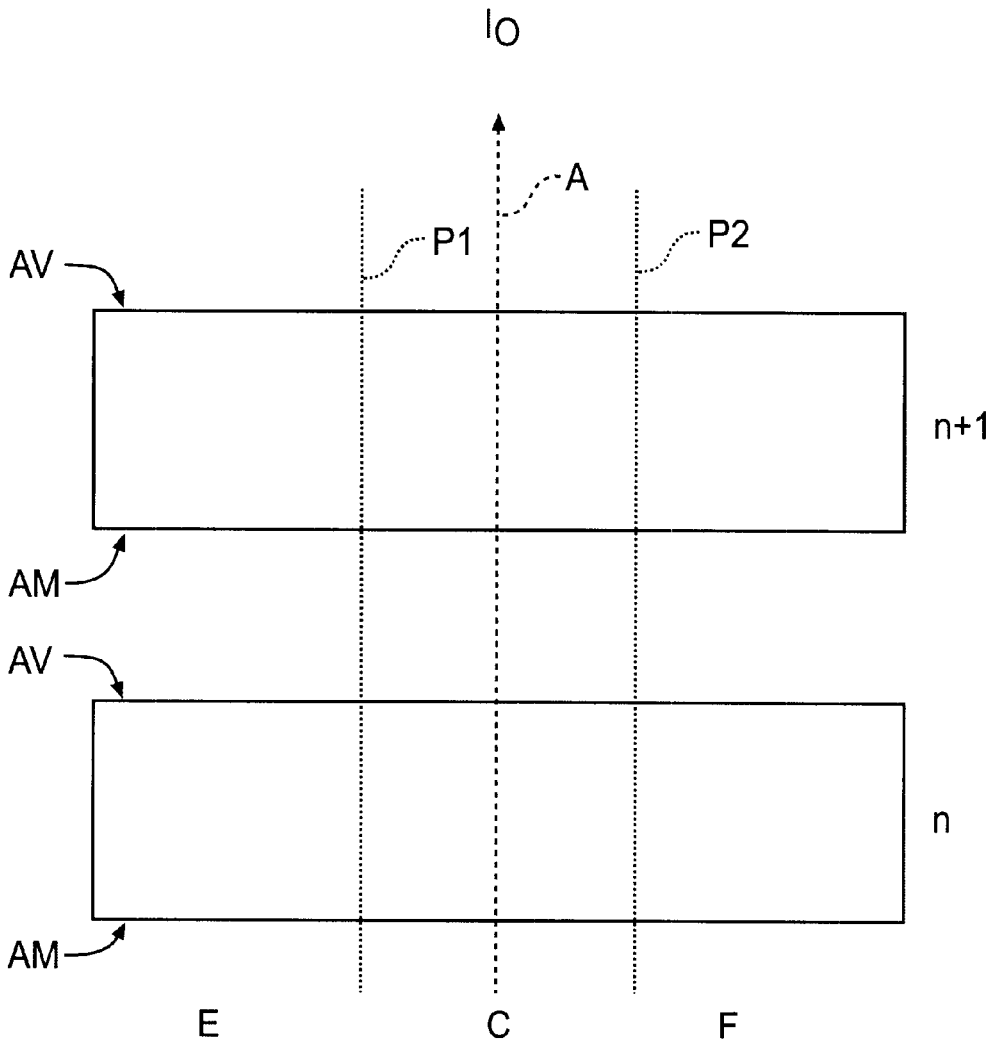

FIG. 2 illustrates the current distribution parameters in a line of electrolysis pots according to the invention. Only two pots have been shown in order to simplify the figures: one upstream pot rank n and one downstream pot rank n+1. The upstream side of a pot is identified by the letters AM; the downstream side is identified by the letters AV. The lateral and central zones of the pot plane are delimited by two vertical planes P1 and P2 parallel to the center line A of the line and located on each side of this center line. The inner lateral, central, and outer lateral zones are identified by the letters F, C and E respectively. The arrow indicates the direction of the electrolysis current.

Figure 3:
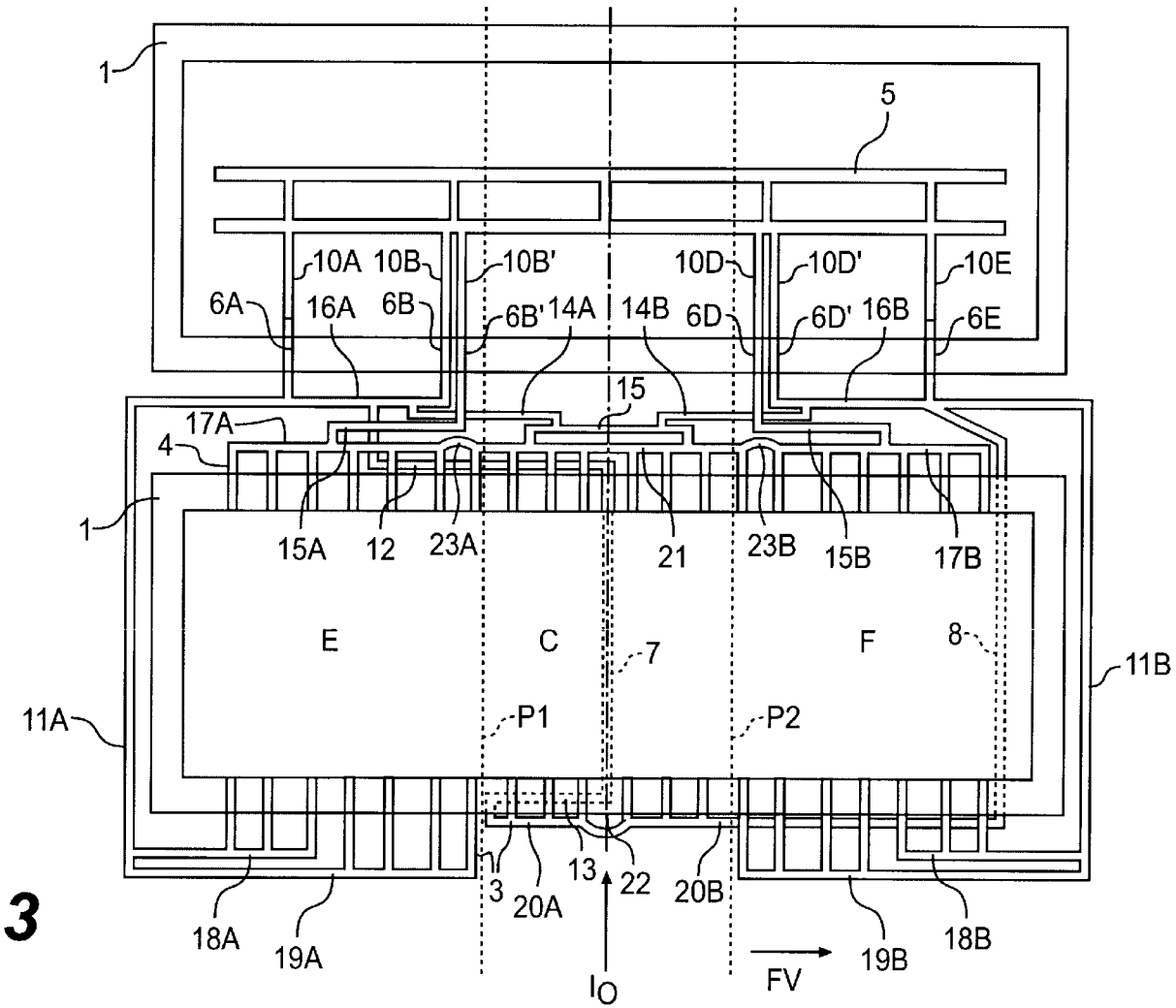

FIG. 3 shows the electrical connection between two successive pots in an arrangement according to the invention. The direction of the neighboring line is indicated by the arrow FV. The direction of the electrolysis current is shown by arrow Io.

DETAILED DESCRIPTION OF THE INVENTION

In one arrangement of pots according to the invention, each pot includes a shell (1) usually made of steel, lined on the inside by insulating refractory materials, anodes and cathodic elements. The anodes and cathodic elements are not illustrated in order to simplify the figures. The cathodic elements include carbonaceous blocks and cathodic bars sealed in the said blocks; one cathodic element usually includes one or two cathodic bars. The cathodic bars project on each side of the pots and form the said upstream (3) and downstream (4) cathodic ends (the term "cathodic end" denotes all cathodic bars for the same element projecting on one side of the pot). In general, the cathodic elements are laid out side by side in the transverse direction of the pots. The anodes, usually formed of prebaked carbonated paste and metallic anode rods sealed in the said paste, are fixed to a moving crosshead (5).

The means of electrical connection between the cathodic ends and the crosshead include rising conductors (or risers) (6A, 6B, 6B', 6C, 6D, 6D', 6E), axial conductors (7), lateral conductors (8) and bypass conductors (11A and 11B). In order to enable the crosshead to move, the risers are connected to the crosshead through flexible electrical conductors (10A, 10B, 10B', 10C, 10D, 10D', 10E). The circuit may include intermediate conductors (12, 13, 14A, 14B, 15A, 15B, 16A, 16B, 17A, 17B, 18A, 18B, 19A, 19B, 20A, 20B, 21) and conductors for equipotential links (22, 23A, 23B) to distribute the electrolysis current in the risers.

The current intensity I1 is preferably comparable to current intensity I2, in that their values are not more than 15% different from the average of I1 and I2 (in other words (I1+I2)/2).

Preferably, there is a single axial conductor. Also preferably, there is a single lateral conductor. It is also advantageous if there is a single bypass conductor (called the inner bypass conductor) that bypasses the pot on the inside and/or a single bypass conductor (called the external bypass conductor) that bypasses the pot on the outside. These measures result in an efficient embodiment of the invention while maintaining a relatively simple electrical circuit.

According to one preferred embodiment of the invention, each pot includes at least one inner bypass conductor and at least one outer bypass conductor, and the intensity Ii of the current circulating in the or all inner bypass conductor(s) is comparable to the intensity Ie of the current circulating in the or all outer bypass conductor(s). Preferably, the intensities Ii and Ie are not more than 15% different from the average of Ii and Ie, (in other words (Ii+Ie)/2).

In the preferred embodiment of the invention, the central riser 6C does not carry any current and is preferably omitted, the risers (6A, 6B, 6B', 6D, 6D', 6E) are placed symmetrically on each side of the axial plane of the line outside the said central zone C, each pot includes a single axial conductor (7), a single lateral conductor (8), a first single bypass conductor (11B) on the side of the neighboring line or the "inner side", and a second single bypass conductor (11A) on the side opposite the neighboring line or the "outer side". No current passes under the shell in the zone E located on the outer side of the pot.

The risers are preferably located between the pots, in other words between two adjacent sides of successive pots. Preferably, the number of the said risers is even and an equal number of risers is placed on each side of the center line of the line.

Preferably, the intensity of the current passing through the axial conductor (7) and the intensity of the current circulating in the lateral conductor (8) are comparable, in other words they are less than 15% different from the average of their values. Preferably, the intensity of the current in the bypass conductors (11A, 11B) is also comparable.

Preferably, the or each lateral conductor passing under the pot is located close to the end of the pot, and even more preferably close to the last cathodic end.

In practice, the N pots in a line typically include two end pots (namely pot rank 1 and pot rank N) which do not have an upstream or a downstream pot, or in which the upstream or downstream pot is not located at the same distance as the pots in the line (which are usually all at the same distance), or for which the upstream or the downstream pot is not located along the center line of the line. In these cases, the configuration of the power supply conductors for the first pot in the line and/or the connection conductors for the last pot in the line to the electrical circuit or to the next line may be different from the configuration of the connecting conductors between the N pots in the line. In particular, the said connection conductors to the last pot do not necessarily include risers.

Comparative Tests

Temperature measurements were carried out on an arrangement of pots according to the most similar prior art (FIG. 1) and on a prototype arrangement of pots according to the invention (FIG. 3). In these tests, each pot included 20 cathodic ends on each side, in other words 20 ends on the upstream side and 20 ends on the downstream side. Each cathodic end included two cathodic bars. The electrolysis current Io was approximately the same in all these tests, namely 300 kA. Neighboring lines were located at the same distance in all cases, namely about 85 m center to center. The current Io' circulating in the neighboring lines was approximately equal to the electrolysis current Io.

In the arrangement of electrolysis pots according to prior art (FIG. 1), the distribution of the cathodic current (Im) from upstream ends into the transmission conductors was as follows: 15 kA in conductor (9A), 7.5 kA in conductor (9B), 22.5 kA in conductor (9C), 52.5 kA in conductor (11A) and 52.5 kA in conductor (11B) The total cathodic current in the downstream pot was distributed in the risers as follows: 60 kA in risers (6A) and (6E), 15 kA in risers (6B) and (6D'), 45 kA in risers (6B') and (6D), and 60 kA in the central riser (6C). Each cathodic end carried a current of approximately the same intensity, namely about 7.5 kA.

There were seven risers, laid out as shown in FIG. 1. These risers were laid out between the upstream and the downstream pots symmetrically on each side of the centerline of the line of pots.

In the arrangement according to the invention, the configuration of the electrical conductors was similar to the configuration shown in FIG. 3. The three zones separated the plane of the pot into three surfaces with approximately the same dimensions, in other words planes P1 and P2 intersected the plane of the pot so as to form a central zone (C) corresponding to 32% of the liquid mass and two lateral zones (one zone E on the outside and one zone F on the side of the neighboring line), each corresponding to 34% of the liquid mass (taking account of the ridges). The central zone included 6 cathodic ends and each lateral zone included 7 cathodic ends. Each of the cathodic ends carried approximately the same current intensity, namely about 7.5 kA.

The distribution of the current originating from the upstream cathodic ends (Im) or the "upstream current" into the transmission conductors was as follows: 20.0 kA in the axial conductor (7), 25.0 kA in the lateral conductor (8), 52.5 k(A in the bypass conductors (11A) and (11B). This distribution corresponds to 13.3% in the axial conductor, 16.7% in the lateral conductor, 35% in the bypass conductor on the side of the neighboring line and 35% in the bypass conductor on the outer side.

The distribution of the total cathodic current from the downstream pot into the risers was as follows: 76.5 kA in risers (6A) and (6E), 28.0 kA in risers (6B) and (6D') and 45.5 kA in risers (6B') and (6D). Therefore the upstream current circulating in the central zone was zero.

There were six risers, with three risers in the outer lateral zone and three risers in the inner lateral zone (and therefore no riser in the central zone). These risers were laid out between the upstream and downstream pots and symmetrically on each side of the centerline of the pot line.

Temperatures were measured using thermocouples inserted in the vertical wall of the pot shell and laid out around the shell. In pots according to prior art, the measurements were made on twenty pots in the same line. For pots according to the invention, the measurements were made on three pots in line.

These tests demonstrated that the arrangement according to the invention can significantly reduce the temperature difference between the upstream and downstream sides of each pot. Typically, the difference between the temperatures measured in the central zone on the upstream side at the level of the interface between the electrolysis bath and the liquid metal, and the temperatures measured in the central zone on the downstream side also at the level of the interface between the electrolysis bath and the liquid metal, observed on pots according to the invention, was 25° C.±10° C. less than values observed on pots according to prior art.

ADVANTAGES OF THE INVENTION

The arrangement of the pots according to the invention can advantageously modify the lines of pots in existing plants without requiring a large investment.

What is claimed is:

1. An arrangement of electrolysis pots suitable for use for the production of aluminum by igneous electrolysis according to the Hall-Héroult process with an electrolysis current with intensity Io comprising:

juxtaposed zones including an inner lateral zone, a central zone, and an outer lateral zone, at least one first line of electrolysis pots forming a first electrical circuit, at least one second electrical circuit located at a determined average distance from said first line, wherein said first line includes N pots arranged crosswise and connecting conductors to transmit said electrolysis current Io from an upstream pot in the first line, to a downstream pot in said first line, each pot in said first line comprising a metal shell, at least one internal lining element, at least one anode and at least one cathodic element, each of said cathodic elements being provided with cathodic connection ends, wherein a first part Im of the current Io being output through the cathodic ends exits from the upstream side of each pot, and a second part Iv of the current Io being output through the cathodic ends exits from the downstream side of each pot, said connecting conductors further including risers, the current Io being output from all cathodic elements in an upstream pot being transmitted to the anodes of a downstream pot through said risers, at least one axial conductor that passes under each upstream pot in the central zone, at least one lateral conductor that passes under each upstream pot in the inner lateral zone, at least one bypass conductor that goes around each upstream pot, and wherein each lateral conductor is connected to a first set of said cathodic ends located on an upstream side in order to transmit a first part I1 of the current Im comprising between 10 and 20% of the said current Im, to said risers, each axial conductor is connected to a second set of the said cathodic ends located on an upstream side in order to transmit a second part I2 of the said current Im comprising between 10 and 20% of the said current Im, to said risers, and each bypass conductor is connected to a third set of the said cathodic ends located on an upstream side in order to transmit a third part I3 of the current I comprising a remaining portion of the current Im, and further wherein said risers connect the cathodic ends located on the downstream side of the corresponding upstream pot to the conducters passing under said pot and to each bypass conductor of the said pot, such that a fraction Mc of the current Io less than 15% is transmitted through the risers located in the central zone of the first line.

2. An arrangement according to claim 1, wherein the fraction Mc is less than 10%.

3. An Electrolysis plant including at least one arrangement of electrolysis pots according to claim 2.

4. An Arrangement according to claim 1, wherein the risers are located between two adjacent sides of successive pots.

5. An Electrolysis plant including at least one arrangement of electrolysis pots according to claim 4.

6. An Arrangement according to claim 1, wherein the second circuit includes at least one pot.

7. An Electrolysis plant including at least one arrangement of electrolysis pots according to claim 6.

8. An Arrangement according to claim 1, wherein there is a single axial conductor.

9. An Electrolysis plant including at least one arrangement of electrolysis pots according to claim 8.

10. An Arrangement according to claim 1, wherein there is a single lateral conductor.

11. An Electrolysis plant including at least one arrangement of electrolysis pots according to claim 10.

12. An Arrangement according to claim 1, wherein the intensity of current I1 and the intensity of current I2 are less than 15% different from the average of I1 and I2.

13. An Electrolysis plant including at least one arrangement of electrolysis pots according to claim 12.

14. An Arrangement according to claim 1, wherein each pot has a single bypass conductor.

15. An Electrolysis plant including at least one arrangement of electrolysis pots according to claim 14.

16. An arrangement according to claim 1, wherein each pot includes at least one inner bypass conductor and at least one outer bypass conductor, and wherein the intensity Ii of a current circulating in all inner bypass conductors, and the intensity Ie of a Current circulating in all outer bypass conductors, are less than 15% different from the average of Ii and Ie.

17. An Electrolysis plant including at least one arrangement of electrolysis pots according to claim 16.

18. An arrangement according to claim 1, wherein each pot includes a single bypass conductor on the outer side and a single bypass conductor on the inner side.

19. An Electrolysis plant including at least one arrangement of electrolysis pots according to claim 18.

20. An Electrolysis plant including at least one arrangement of electrolysis pots according to claim 1.

21. An arrangement according to claim 1, wherein said central zone is located in the vicinity of a central axis and said central zone corresponds to from 25≧40% of the volume inside said pots.

22. An arrangement according to claim 1, wherein said inner lateral zone is located on the same side of said arrangement as said second electrical circuit.

* * * * *

UNITED STATES PATENT AND TRADEMARK OFFICE

CERTIFICATE OF CORRECTION

PATENT NO. : 6,551,473 B1
DATED : April 22, 2003
INVENTOR(S) : Jean-Marie Gaillard It is certified that error appears in the above-identified patent and that said Letters Patent is hereby corrected as shown below:

Column 8,
Line 35, "Current" should read -- current --
Line 49, "25>=40%" should read -- 25-40% --

Signed and Sealed this

First Day of July, 2003

JAMES E. ROGAN
*Director of the United States Patent and Trademark Office*